United States Patent [19]

Slavik

[11] 4,098,044

[45] Jul. 4, 1978

[54] SHEATHING BOARD

[76] Inventor: Raymond F. Slavik, 2281 Hampden Ave., St. Paul, Minn. 55114

[21] Appl. No.: 809,548

[22] Filed: Jun. 24, 1977

[51] Int. Cl.[2] ..... E04C 1/08

[52] U.S. Cl. ..... 52/503; 52/303

[58] Field of Search ..... 52/503–506, 52/303–305

[56] References Cited

U.S. PATENT DOCUMENTS

| | | | |
|---|---|---|---|
| 2,899,716 | 8/1959 | Woodward | 52/303 |
| 3,772,840 | 11/1973 | Hala | 52/303 |

*Primary Examiner*—J. Karl Bell

*Attorney, Agent, or Firm*—Burd, Braddock & Bartz

[57] ABSTRACT

A sheathing panel is adapted for mounting to the outside of a structure wall framework. Each panel has an inside surface including top and bottom portions positionable against horizontal frame members of the framework, and two side portions positionable against framework vertical frame members. Grooves in the inside surface extend downwardly from the panel top edge below the top edge portion to allow passage of air between said portion and its associated horizontal frame member. A horizontal channel in the inside surface allows passage of air between the surface and any abutting vertical frame member. A horizontal manifold at the panel bottom edge substantially spans the panel width. A plurality of slots in the inside surface extend downwardly from above the bottom edge portion toward the manifold, stopping short thereof to form a partition between each groove and manifold. The side edges of the panels are shiplapped to facilitate mounting of a plurality of panels in a horizontal row. Top panels can be mounted in rows above a bottom horizontal row. Bottom panels are mounted unaltered. Prior to the mounting of each top panel, the partitions are removed to effectively extend the slots to the manifold.

13 Claims, 5 Drawing Figures

66
56
20a
20b
20c
12c
38
70
72a
72b
72d
68
54
64

68
38
92
84
80
138
150

76a
76b
76c
76d
50
90
74
38
70
78a
78b
78c
78d
138
68
84
S
88
80
86
82
150

SHEATHING BOARD

BACKGROUND OF THE INVENTION

Sheathing is a basic and necessary part of exterior wall construction. Early sheathing usually comprised 8 inch wide board nailed horizontally with shiplapped top & bottom edge to facilitate joinder. The board was usually covered with a layer of tar paper. Approximately 20 years ago, board was replaced by plywood as the most common sheathing material. More recently fiber board has replaced plywood as the most common sheathing material.

Resulting from concern about the cost and availability of energy, thermal insulative quality is an increasingly important consideration in selecting sheathing materials. Frequently used, for example, are urethane foam and expanded polystyrene having insulative value at least four times that of fiber board.

Two problems arise with the use of high insulative sheathing. First, it fails to ridigify the "two-by-four" structure wall framework in the manner typical of prior sheathing. Use of metal or wood corner bracing is a convenient solution. The second problem arises from the fact that high insulative sheathing is nonpermeable to moisture. In colder climates, warm and humid inside air infiltrates the wall, causing moisture condensation on portions of the wall framework and sheathing having temperature below the dew point for the inside air. Due to the barrier formed by the sheathing, moisture is unable to migrate further outward and collects inside the wall, reducing the insulative efficiency of any fibrous insulation between frame members, and possibly damaging the wall.

Sufficient movement of air within the wall evaporates such moisture, thereby preventing its accumulation. Usually the tendency of warm air to rise in the wall provides sufficient air movement. One method of maintaining an air flow is to install corrugated plastic vent strips between the sheathing and each horizontal frame member of the framework. The vent strips maintain spaces between the sheathing and frame members to allow free upward movement of air to the structure attic.

Of course the cost of installing sheathing increases due to the extra material and labor in mounting the vent strips. A more serious hazard is the practice of applying high insulative sheathing without use of vent strips, usually due to failure to recognize the problem of moisture accumulation. Moreover, a contractor may disregard instructions and install sheathing without strips or other vent means, saving money initially, but thereby causing serious long range consequences.

SUMMARY OF INVENTION

The invention relates to sheathing adapted for mounting to a structure wall framework. The sheathing includes a plurality of thermally insulative and moisture impermeable panels. Each panel has a substantially planar inside surface including a surface portion adjacent the panel circumferential edge and positionable against selected frame members of the structure wall framework.

The rectangular panels shown are particularly well suited to typical residential construction, wherein the framework includes a plurality of equally spaced apart vertical frame members arranged between a top horizontal frame member and a bottom horizontal frame member. The surface portion of each rectangular panel includes a top portion positionable against the top frame member, a bottom portion positionable against the bottom frame member and two opposed side portions positionable against vertical frame members.

A plurality of grooves is shown in the panel inside surface, each groove extending downward from the top edge to a point below the top portion. These grooves permit movement of air between the top portion and the top horizontal frame member when the panel is mounted against the framework. The panel as shown also includes a plurality of horizontal channels in the inside surface across the panel width, permitting movement of air between the inside surface and any vertical frame members contacting it near the channels.

The panel shown is readily adaptable to multi-story structures requiring two or more intermediate horizontal frame members. Each panel has at the bottom an elongated horizontal manifold spanning the distance between the two side portions and open to the interior panel surface. A plurality of slots originate above the bottom portion and extend downward to a point just short of the manifold, forming a partition between each slot and the manifold. When the bottom portion is positioned against a horizontal member, the partitions prevent movement of air between the slots and manifold.

Each panel in a bottom horizontal row, i.e. each bottom panel, is installed as manufactured so that air is substantially prevented from passing between the bottom portion and the bottom frame member. Each panel in a row above the bottom row., i.e. each top panel, is modified before installation in that the partition between each slot and the manifold is removed. Consequently, air is permitted to pass between the manifold and each slot when the bottom portion is positioned against an intermediate horizontal frame member.

The panels are installed in vertical alignment, the bottom edge of each top panel abutting the top edge of the panel beneath it. Precise vertical alignment between the grooves of a panel and slots of a panel directly above it is not necessary, however, since all grooves and slots are in communication with the manifold of the top panel. The groovemanifold slot cooperation in adjoining panels permits free movement of air from the lower portion of the structure wall, past all horizontal frame members and finally out of the wall, without vent strips or any other additional venting means.

Elimination of the vent strips reduces a labor and time in sheathing installation. More importantly, the panel construction provides a simple and convenient method of proper installation. The only additional labor required for proper ventilation is the removal of the partitions from top panels, by cutting with a utility knife or breaking away by hand. The ease with which a panel in manufactured form is convertible into a top panel greatly increases the probability of correct installation, since the saving formerly associated with improper installation is eliminated. Cost is further reduced since only one type of panel, rather than a top and bottom panel, need be manufactured.

IN THE DRAWINGS

DESCRIPTION OF PREFERRED EMBODIMENT

Figure 1:
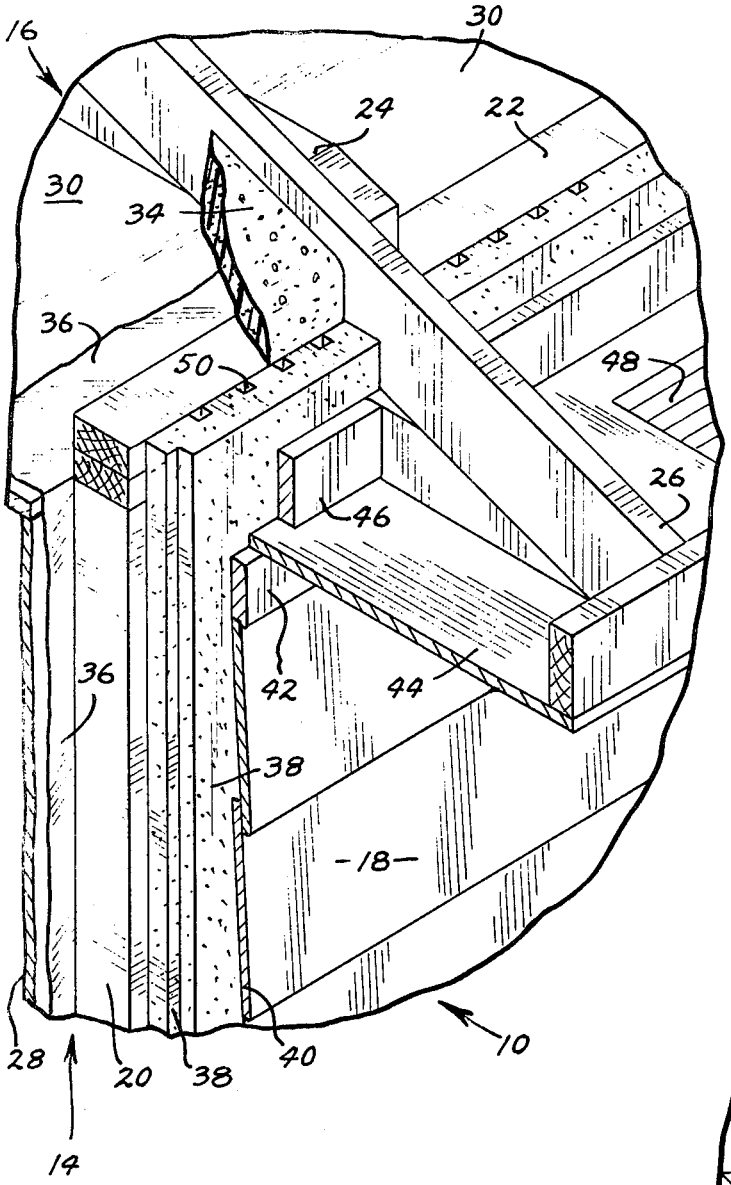
FIG. 1 is a perspective view of part of a structure having an outside wall containing sheathing in accordance with the invention, with parts removed to enhance illustration.
Figure 2:
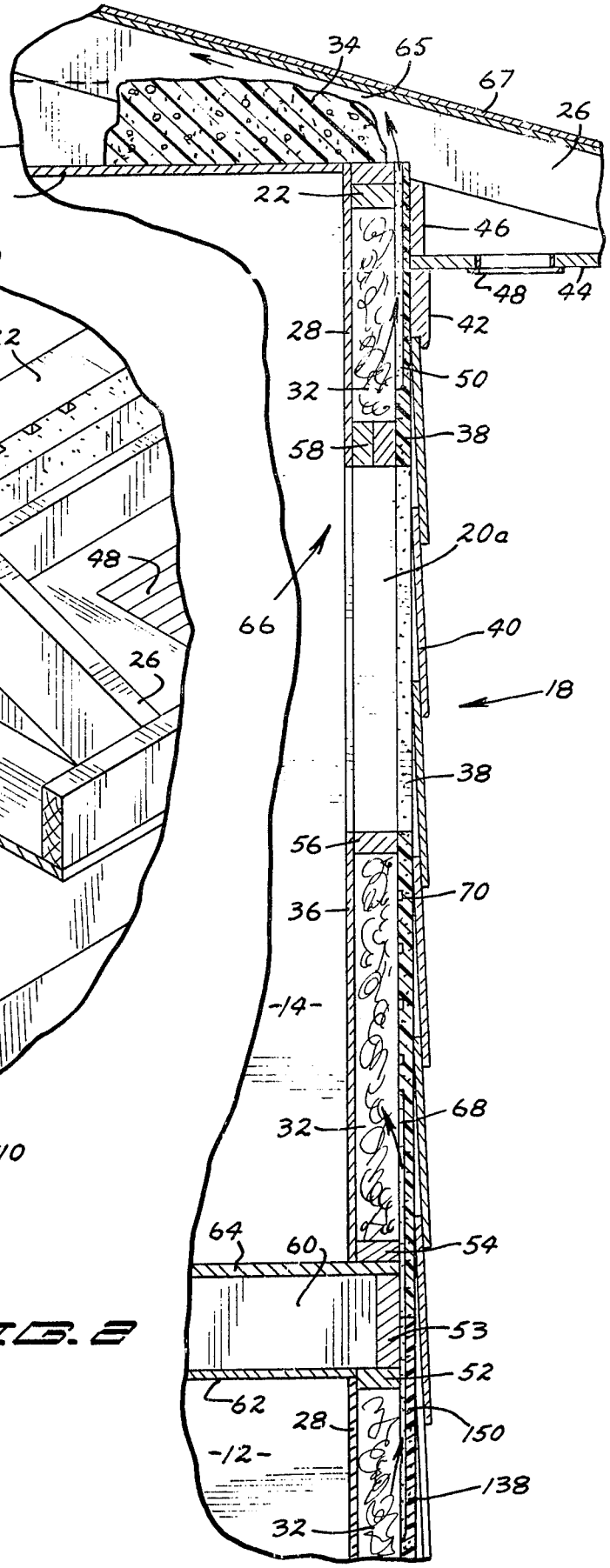
FIG. 2 is a cross sectional view of the structure of FIG. 1 taken along a vertical plane passing through the structure.

FIGS. 1 and 2 illustrate portions of a two-story structure 10 having a first story 12, a second story 14 and an attic 16. An exterior wall 18 of the structure derives its principal strength from a supporting framework of nominal "two-by-four" lumber (with actual cross section of 1.5 inches × 3.5 inches or 3.8cm × 8.9cm). The framework includes vertical members or studs 20, and horizontal members such as wall plate 22 joined to the studs. Studs 20 typically are spaced at a distance of 16 inches (40.6cm) between longitudinal axes, while horizontal members are located at the bottom and top of wall 18, between first and second stories 12 and 14, and at windows and doors. Further structure-supporting framework includes horizontal parallel attic joists 24 and inclined parallel rafters 26.

Fastened to the framework is the innermost layer of wall 18, an interior wall 28. A horizontal second story ceiling 30 joins wall 28 and is fastened to attic joists 24. Wall 28 and ceiling 30 can be the same material, for example, plaster board, gypsum board or the like, commonly installed in series of 8 foot (2.4m) long by 4 foot (1.2m) wide sheets. Nails or staples join each sheet to the framework.

Structure 10 is especially adapted for a colder climate, and wall insulation 32 is included between adjacent studs 20 (see FIG. 2). Attic insulation 34 is installed between joists 24. Insulation at 32 and 34 preferably is a fibrous material, for example mineral wool or fiberglass batting. Wall insulation 32 had a thickness of approximately 3 ⅜ inches (8.9cm) corresponding with the width of studs 20. The attic insulation 34 will be at least as thick as the width of attic joists, i.e. 6 inches (15.2cm).

A vapor barrier 36 is inserted between interior wall 28 and studs 20, and between ceiling 30 and joists 24. Vapor barrier 36 can be a thin sheet of non-water permeable material, for example, polyethylene sheeting 6mm in thickness.

The purpose of vapor barrier 36 is to prevent the "migration" of moisture in the form of water vapor from the warmer more humid interior of structure 10 into exterior wall 18. As the moisture-laden interior air moved toward the outside of structure 10 through moisture-permeable insulation 32, it would encounter progressively colder portions of wall 18, eventually reaching wall portions having a temperature at or below the dew point for the moisture-laden air. Condensation would then take place, on framework surfaces and within insulation 32. Moisture accumulation in insulation 32 reduces its thermal resistance, thus defeating the purpose of the insulation. While vapor barrier 36 does not prevent the entry of all moisture into wall 18, moisture can be sufficiently reduced to maintain vapor-flow continuity, a condition of evaporation at least equal to condensation, provided, however, that air can move freely through wall 18.

A top sheathing panel 38 is fastened to the outside surface of the framework directly to studs 20 and to horizontal members by staples or nails. Panel 38 is nonstructural sheathing, that is, lateral support for wall 18 such as of corner bracing by metal strapping or wood strips is required. Such corner bracing is well known in the art and not described herein. Panel 38 is preferably a dimensionally stable material having a high thermal resistivity or "$r$" value, in terms of resistance to passage of heat per inch thickness. Examples of materials which meet this requirement are expanded polystyrene ($r$=4.55), and urethane ($r$=7.1). This compares with an "$r$" value of 0.9 for gypsum board and 1.2 to 1.3 for plywood. Expanded polystyrene, the exemplary material in this preferred embodiment, has the additional advantage of being extremely lightweight.

Siding 40 covers sheathing panel 38 and extends upwardly to a molding strip 42. A soffit 44 is supported between molding 42 and a nailer 46. Air moves through soffit 44 by a vent 48. A plurality of vertical upper grooves 50 in panel 38 extend downward from the panel top edge and allow passage of air from between adjacent studs 20 past wall plate 22 into attic 16.

As seen in FIG. 2, wall construction at first story 12 is substantially similar to that at second story 14, wall insulation 32 occupying spaces between framework members and supported laterally by the interior wall 28 and by sheathing. Horizontal members cooperating with studs 20 include a first floor wall plate 52, a header 53, a sill plate 54, a window sill 56, a window top frame member 58 and top wall plate 22. Normal to header 53 are a plurality of joists 60 supporting a first story ceiling 62 and a second story floor 64. Due to the opening for a window 66, there is no insulation between window sill 56 and top frame member 58.

Arrows in FIG. 2 indicate the upward flow of air in wall 18 toward the top thereof. Air enters the wall from both the inside and outside of structure 10, and tends to rise as it is heated by the relatively warmer structure interior.

Air from the interior contains a relatively high amount of moisture, particularly if it is humidified with a furnace attachment or otherwise. Assuming a sufficiently cold outdoor temperature, outward portions of the insulation and the sheathing inside surface will have a temperature lower than the dew point for the moisture-laden interior air. This results in condensation and accumulation of moisture on the sheathing and insulation as discussed above. Were there no provisions for movement of air upward in wall 18, moisture would accumulate within the wall, reducing the the thermal resistance of insulation 32 and eventually damaging the wall interior.

Sheathing 38 allows free movement of air in the wall interior to relieve moisture accumulation. As indicated by the arrows, air travels through moisture-permeable insulation 32, and upwardly into a series of vertical upper grooves 150 in a bottom sheathing panel 138. Then the air enters a series of vertical lower slots 68 in top panel 38 and into insulation 32 below window sill 56. Since window sill 56 prevents upward flow of air between studs located beneath it, channels 70 are provided which permit movement of air horizontally to a point not under the sill. Finally, air above window top frame member 58 travels through insulation 32 and into vertical upper grooves 50 in top sheathing panel 38. Emerging from the grooves, the air passes through a space 65 between attic insulation 34 and a roof 67, then out through an attic vent.

Figure 3:
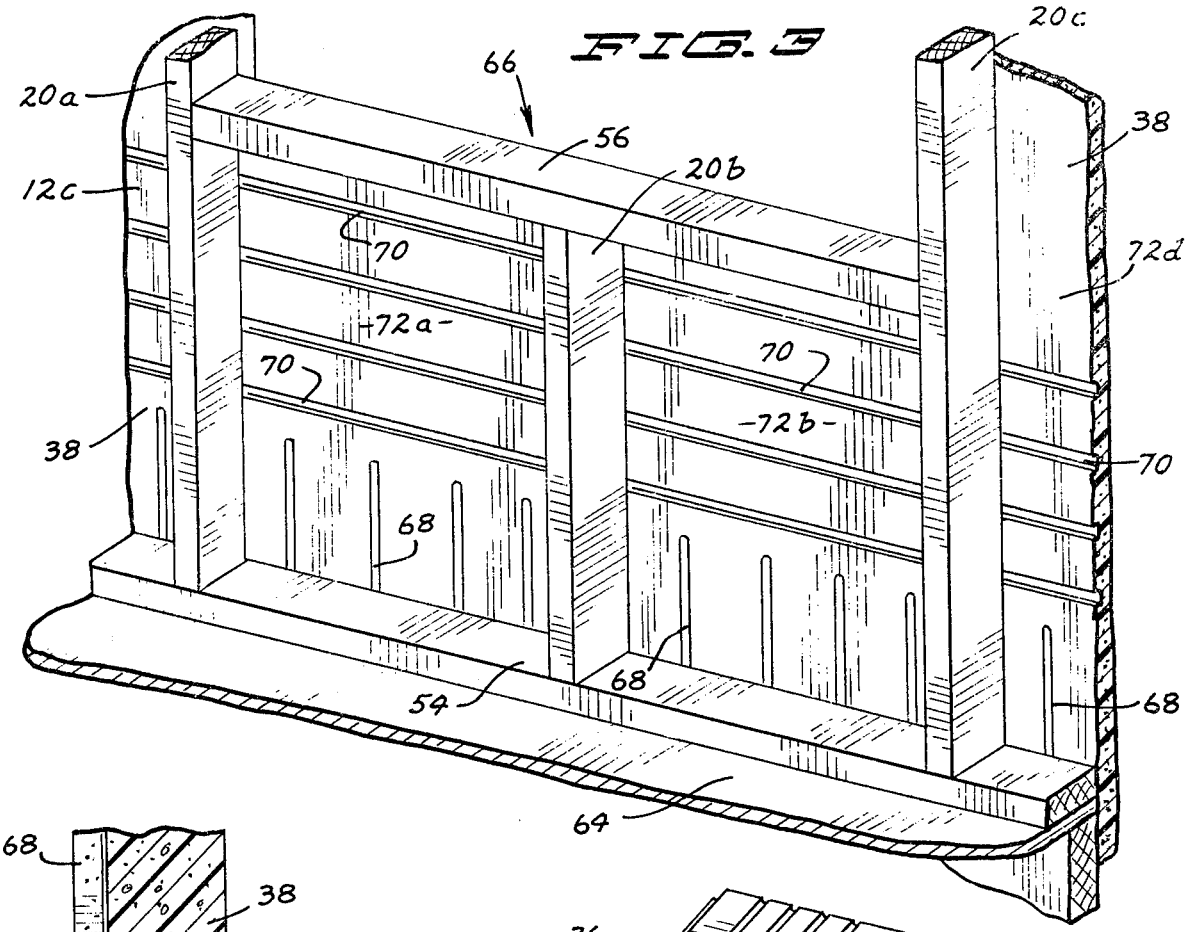
FIG. 3 is a perspective view of the wall as seen from inside the structure, with parts removed to enhance illustration.
Figure 5:
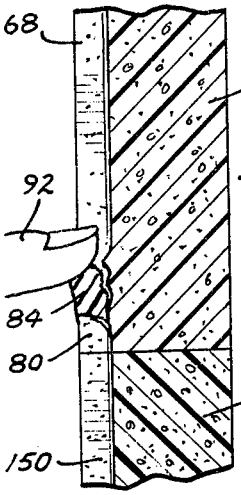
FIG. 5 is enlarged cross sectional view taken along the line 5—5 in FIG. 4.

Provision in top sheathing panel 38 to allow movement of air beneath window sill 56 is shown in more detail in FIG. 3, showing part of structure wall 18. Window 66 is viewed from the structure interior, but with insulation 32, interior wall 28 and vapor barrier 36 removed. Through vertical lower grooves 68, air bypasses header 53 and sill plate 54 to enter a space 72*a* between studs 20*a* and 20*b*, a space 72*b* between studs 20*a* and 20*c*, and spaces 72*c* and 72*d* between studs 20*a*,20*c*, and further studs not shown. Air in spaces 72*a* and 72*b* would ordinarily be trapped by sill 56, resulting in an accumulation of moisture in the insulation and on the sheathing.

Channels 70 prevent such trapping, however, As air enters spaces 72*a* and 72*b*, there is an initial tendency for its entrapment. The accumulation, however, tends to increase the air pressure within the spaces and creates a pressure differential between the spaces and adjoining air spaces 72*c* and 72*d*. The pressure differential causes air to move in channels 70, from space 72*a* to space 72*c* and from space 72*b* to space 72*d*. Once in spaces 72*c* and 72*d*, air is free to rise, unimpeded by sill 56.

Figure 4:
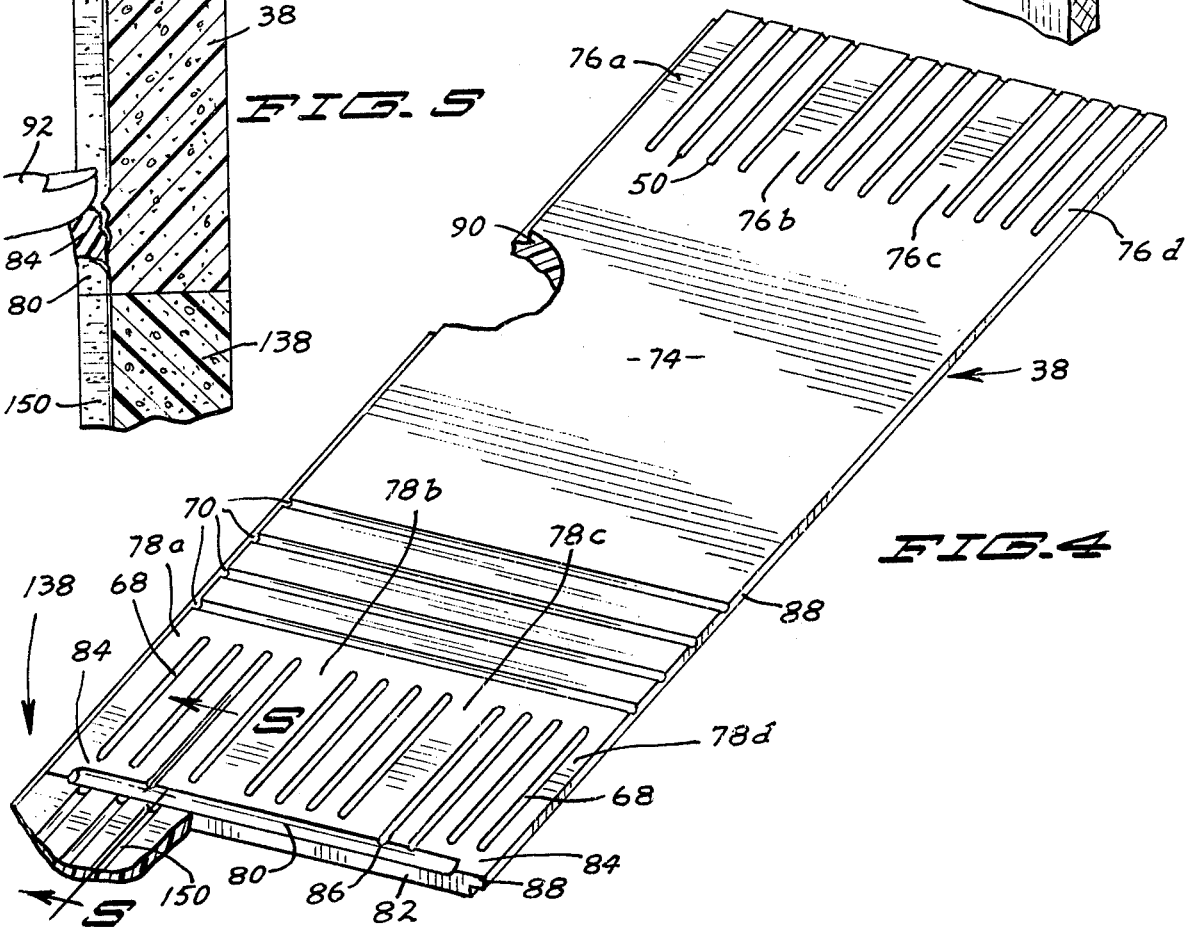
FIG. 4 is a perspective view of a top sheathing panel and part of an adjacent bottom sheathing panel in accordance with the invention.

Top sheathing panel 38 is shown in perspective in FIG. 4. While only top panel 38 is described in detail, top panel 38 and bottom panel 138, as manufactured, are substantially identical. Each bottom panel 138 is applied to the framework unaltered from the manufactured form. Each top panel 38 is slightly modified prior to application in a manner to be explained. It is therefore understood that a description of bottom panel 138 could be identical to the description of top panel 38, except for the substitution of a part number "1XX" for the identical part of number "XX" of top panel 38.

Although panel 38 could be custom-made, it has been found that a size of 4 feet × 9 feet (1.2m × 2.7m) is usually best suited to residential building specifications. An inside surface 74 of top sheathing panel 38 has a circumferential edge including a top portion positionable against wall plate 22, a bottom portion against header 53, and two opposed side portions, each positionable against one of studs 20. Correspondingly, the inside surface of each bottom panel 138 has a circumferential edge including a top portion positionable against a bottom horizontal frame member, and two side portions each positionable against one of studs 20. Further, the inside surfaces of mounted panels 38 and 138 contact intermediate studs and intermediate horizontal frame members; for example, window sill 56.

Vertical upper grooves 50 are arranged in groups to define upper surface areas 76*a*, 76*b*, 76*c* and 76*d*, 16 inches (40.6cm) apart to accommodate the typical spacing between studs in residential structures. Grooves 50 extend downward from the top edge of panel 38 18 inches (45.7cm), a sufficient distance to terminate below the top portion, i.e. below the wall plate 22 when panel 38 is installed. It has been found satisfactory to provide four upper grooves between each adjacent pair of studs, each groove having a width of ½ inch (1.3cm) and a depth of ¼ inch (0.6cm).

Channels 70 preferably are positioned from 1.5 feet (0.5m) to 3 feet (0.9m) from the bottom of panel 38. Satisfactory horizontal air flow has been achieved using four parallel channels 70, each ½ inch (1.3cm) wide and ¼ inch (0.6cm) deep.

Below channels 70 are vertical lower slots 68, grouped to define four lower surface areas 78*a*, 78*b*, 78*c* and 78*d*, spaced 16 inches (40.6cm) apart to accommodate studs 20. Slots 68 extend downward from above the bottom portion. Unlike grooves 50, slots 68 terminate approximately 1 inch (2.5cm) short of a bottom edge 82.

At the bottom of panel 38 and spanning the majority of the panel width is a horizontal manifold 80, having a width of ½ inch (1.3cm) and a depth of ¼inch (0.6cm). Manifold 80 runs transversely of lower slots 68 and is ½ inch (1.3cm) from the bottom end of each lower slot, resulting in a partition 84 between each slot 68 and manifold 80.

The sheathing panels can be manufactured by a molding process, with protrusions in the mold forming indentations for the grooves, channels, slots and manifold. As all indentations are relatively shallow, their effect upon panel strength and insulative efficiency is minimal. Once the mold has been constructed the cost of manufacturing the panels is substantially the same as the cost of manufacturing similarly sized sheathing having no indentations. If desired, the mold inside surface can be modified to form guide marks in the panels for aiding placement of staples or nails.

In the manufactured form, all panels are adapted to function as bottom panels 138. With bottom panel 138 fastened against a horizontal frame member, each partition 84 substantially prevents movement of air from the manifold into the associated slot 68. Such is the desired result in each bottom panel, as the amount of air entering structure wall 18 from outside of structure 10 should be minimized. Each bottom panel is therefore installed unaltered from the manufactured form.

Each panel 38, by contrast, is not installed as manufactured. If such were the case, partitions 84 would abut header 53 and prevent upward flow of air from manifold 80 into lower slots 68, causing stagnation and moisture accumulation. Each of top panels 38 is made by a slight modification of the manufactured form. Partitions 84 are permanently removed from the panel to effectively extend slots 68 downward to manifold 80. Such extension of a slot is seen at three locations 86 in FIG. 4. Partitions 84 are broken off by a finger 92 as shown, or cut with a utility knife. In either case, all partitions are removed, permitting air from grooves 150 of bottom panel 138 to pass through manifold 80 into slots 68 of top panel 38. As perhaps best seen in FIG. 4, the lateral design of manifold 80 assures free air movement from grooves 150 to slots 68, regardless of whether any pairs of said grooves and slots are vertically aligned.

For total coverage of wall 18, a plurality of bottom panels 138 are mounted side-by-side in a first horizontal row, while a plurality of top panels 38 are installed in a second horizontal row immediately above the first row. The bottom edge of each top panel abuts the top edge of the bottom panel beneath it. To facilitate installation in rows, each of the top and bottom panels is provided with shiplapped vertical edges. These are described only in connection with top panel 38 with the understanding that the bottom panel edges are substantially identical to the top panel edges. A first flange 88 of uniform horizontal rectangular cross section protrudes from panel 38 over the inside half of the panel thickness. Similarly, a second flange 90 protrudes from the opposite side of the panel and from the outside half of the panel thickness. Horizontally adjacent panels thus present complementary joining edges. As compared to flat edge construction, the shiplapping provides a positive and accurate connection between adjacent panels and presents an improved air, thermal and moisture barrier. Installation time is reduced since each nail or staple at a junction anchors two adjacent panels rather than merely one.

It is understood that while a two-story structure has been described, the sheathing is equally adaptable to one-story and multiple-story buildings. A single-story structure requires one horizontal sheathing row consisting entirely of bottom panels 138; therefore no panels are converted from the manufactured form. For a structure having three or more stories, a corresponding number of sheathing rows is required. Bottom panels are installed in the first or bottom row, while the remaining rows contain only top panels, modified from the manufactured form as described.

The embodiments of the invention in which an exclusive property or privilege is claimed are defined as follows:

1. A sheathing forming part of a structure wall having a plurality of horizontal and vertical interconnected spaced-apart frame members:

said sheathing including:

A. a plurality of sheathing panels having relatively high thermally insulative properties and each panel having a substantially planar interior surface bounded by generally horizontal and generally upright circumferential edges;

B. means for fastening said panels in contiguous relation to each other and to have their interior surfaces in contacting relation to exterior surfaces of said frame members, each of said panels contacting a horizontal frame member along an upper circumferential edge thereof; and C. said panels each being provided with at least one groove open to said interior surface and, when so fastened, open to its upper circumferential edge between each pair of adjacent vertical frame members.

2. A sheathing forming part of a structure wall having a plurality of horizontal and vertical interconnected spaced-apart frame members:

said sheathing including:

A. a plurality of sheathing panels having relatively high thermally insulative properties and each panel having a substantially planar interior surface bounded by generally horizontal and generally upright circumferential edges;

B. means for fastening said panels in contiguous relation to each other and to have their interior surfaces in contacting relation to exterior surfaces of said frame members, each of said panels contacting a horizontal frame member along an upper circumferential edge thereof;

C. said panels each being provided with at least one groove open to said interior surface and, when so fastened, open to its upper circumferential edge between each pair of adjacent vertical frame members;

D. wherein at least one upper panel is fastened to said frame members above another and lower panel to be in contiguous relation to said lower panel and in contacting relation to a horizontal frame member along a lower circumferential edge of said upper panel;

E. said upper panel being provided with at least one slot open to said interior surface of the panel, and, when so fastened, open to its lower circumferential edge between each pair of adjacent vertical frame members; and F. means provided by a said contiguous upper and lower panels for providing a passage for air between the grooves of the lower panel and the slots of the upper panel.

3. The sheathing of claim 2 wherein:

said means for providing air passage between the upper and lower panels consist of a manifold provided in one of said panels open to said interior surface and open to said slots and said grooves.

4. The sheathing of claim 1 wherein:

at least some of said panels are each provided with a plurality of generally horizontal spaced-apart channels open to said interior surface and open to said upright circumferential edges.

5. Sheathing for use in contiguous relationship to each other to form a sheathing as part of a structue wall which has horizontal and vertical interconnected, spaced-apart frame members and a sheathing fastened in contacting relation to exterior surfaces of said frame members;

each of said sheathing panels having relatively high thermally insulative properties and a substantially planar interior panel surface adapted to be fastened in contacting relation to said exterior frame member surfaces bounded by generally horizontal and generally upright circumferential edges; and each panel being provided with a plurality of generally upwardly extending grooves open to said interior panel surface and to an upper circumferential panel edge.

6. Sheathing for use in contiguous relationship to each other to form a sheathing as part of a structure wall which has horizontal and vertical interconnected, spaced-apart frame members and a sheathing fastened in contacting relation to exterior surfaces of said frame members;

each of said sheathing panels having relatively high thermally insulative properties and a substantially planar interior panel surface adapted to be fastened in contacting relation to said exterior frame member surfaces bounded by generally horizontal and generally upright circumferential edges; and each panel being provided with a plurality of generally upwardly extending grooves open to said interior panel surface and to an upper circumferential panel edge;

wherein said panels are also provided with a plurality of generally downwardly extending slots open to said interior panel surface and to a lower circumferential panel edge.

7. The sheathing panels of claim 6 wherein:

each panel is provided with a manifold open to the interior panel surface, to the lower circumferential panel edge, and to each of the downwardly extending slots.

8. The sheathing panels of claim 6 wherein:

each panel is also provided with a plurality of generally horizontal, spaced-apart channels, open to said interior panel surface and open between opposite upright circumferential edges.

9. Sheathing for use in contiguous relationship to each other to form a sheathing as part of a structure wall which has horizontal and vertical interconnected, spaced-apart frame members and a sheathing fastened in contacting relation to exterior surfaces of said frame members;

each of said sheathing panels having relatively high thermally insulative properties and a substantially planar interior panel surface adapted to be fastened in contacting relation to said exterior frame member surfaces bounded by generally horizontal and generally upright circumferential edges; and each panel being provided with a plurality of generally upwardly extending grooves open to said interior panel surface and to an upper circumferential panel edge;

wherein each panel is also provided with a plurality of generally horizontal, spaced-apart channels, open to said interior panel surface and open between opposite upright circumferential edges.

10. Sheathing for use in contiguous relationship to each other to form a sheathing as part of a structure wall which has horizontal and vertical interconnected, spaced-apart frame members and a sheathing fastened in contacting relation to exterior surfaces of said frame members;

each of said sheathing panels having relatively high thermally insulative properties and a substantially planar interior panel surface adapted to be fastened in contacting relation to said exterior frame member surfaces bounded by generally horizontal and generally upright circumferential edges; and each panel being provided with a plurality of generally upwardly extending grooves open to said interior panel surface and to an upper circumferential panel edge;

wherein each panel is provided with a manifold open to the interior of the panel surface and to a lower circumferential panel edge; and each panel is provided with a plurality of parallel slots open to said interior panel surface at a lower portion of the panel and terminating in slightly spaced relationship with respect to an upper edge surface of said manifold.

11. The sheathing panel of claim 10 wherein:

the portion of said panels situated between said manifold and each of said slots forms a partition or wall to substantially prevent the passage of air from said manifold into each of said slots; and each of said partitions is frangible to allow modification of said panels to provide an air passageway between said manifold and each of said slots by physically removing said partition before installation of said panels to form a sheathing for a structure wall.

12. A method of applying the sheathing of claim 11 to the structure wall framework, including:

A. Permanently fastening a first panel to the framework whereby its upper circumferential panel edge contacts am intermediate horizontal frame member, its lower circumferential panel edge contacts a bottom horizontal frame member, and its upright panel edges contact vertical frame members;

B. Forming a top panel by removing, from a second panel, the partition between each slot and the manifold to provide an air passageway between said manifold and each of said slots;

C. Permanently fixing the top panel to the framework whereby its upper circumferential panel edge contacts a top horizontal frame member, its upright circumferential panel edges contact vertical frame members and its lower circumferential edge abuts the top edge of said first panel; and D. Repeating steps A through C until the framework is substantially covered.

13. The method of claim 12 including:

Trimming any excess sheathing after the framework has been substantially covered.

* * * * *